US008991220B2

(12) United States Patent
Buso et al.

(10) Patent No.: US 8,991,220 B2
(45) Date of Patent: Mar. 31, 2015

(54) WASHING MACHINE WITH AN IMPROVED WASHING/RINSING-LIQUID INLET CIRCUIT

(75) Inventors: Danny Buso, S. Quirino (IT); Pietro Rizzetto, S. Stino di Livenza (IT)

(73) Assignee: Electrolux Home Products Corporation N.V., Raketstraat (BE)

( * ) Notice: Subject to any disclaimer, the term of this patent is extended or adjusted under 35 U.S.C. 154(b) by 655 days.

(21) Appl. No.: 13/263,277

(22) PCT Filed: Apr. 8, 2010

(86) PCT No.: PCT/EP2010/002192

§ 371 (c)(1),
(2), (4) Date: Nov. 10, 2011

(87) PCT Pub. No.: WO2010/127753

PCT Pub. Date: Nov. 11, 2010

(65) Prior Publication Data

US 2012/0067089 A1 Mar. 22, 2012

(30) Foreign Application Priority Data

Apr. 9, 2009 (EP) ..... 09005226
Sep. 14, 2009 (EP) ..... 09011716

(51) Int. Cl.
*D06F 39/02* (2006.01)
*D06F 39/08* (2006.01)
*D06F 21/00* (2006.01)

(52) U.S. Cl.
CPC ..... *D06F 39/02* (2013.01)
USPC ..... 68/17 R; 68/3 R

(58) Field of Classification Search
CPC ..... D06F 39/02
USPC ..... 68/3 R, 17 R
See application file for complete search history.

(56) References Cited

U.S. PATENT DOCUMENTS 4,981,024 A * 1/1991 Beldham ..... 68/12.18
7,900,486 B2 * 3/2011 Richman et al. ..... 68/17 R (Continued)

FOREIGN PATENT DOCUMENTS

DE 90 11 398 3/1991
DE 197 57 303 6/1999

(Continued)

OTHER PUBLICATIONS

International Search Report issued in corresponding International Application No. PCT/EP2010/002192, mailed Aug. 27, 2010.

(Continued)

*Primary Examiner* — Michael Barr
*Assistant Examiner* — Benjamin L Osterhout
(74) *Attorney, Agent, or Firm* — Banner & Witcoff, Ltd.

(57) ABSTRACT

A washing machine (1) has a washing tub (5) containing a rotary perforated drum (6), and a washing/rinsing-liquid dispenser (8), fluidly connectable to a water source. The liquid dispenser includes a housing (9) and a drawer (10), removably associated to the housing (9), provided with one or more compartments (11*a*, 11*b*) adapted to be filled with washing and/or rinsing products. A water line (13) fluidly connects the washing/rinsing-liquid dispenser (8) and the tub (5). The water line (13) has one or more single-piece elements (13, 13*a*. 13*b*) including a first conduit (25), fluidly connecting the one or more compartments (11*a*, 11*b*) and the tub (5), and a second conduit (27), fluidly separated from the first conduit (25), fluidly connectable, upstream, with the water source, and fluidly connected, downstream, with the tub (5)). The first and second conduits (25, 27) are provided in a single-piece construction.

12 Claims, 17 Drawing Sheets

(56) References Cited

U.S. PATENT DOCUMENTS

| | | | | |
|---|---|---|---|---|
| 2009/0053119 | A1* | 2/2009 | Richman et al. | 422/300 |
| 2010/0170046 | A1* | 7/2010 | Wong et al. | 8/137 |

FOREIGN PATENT DOCUMENTS

| | | |
|---|---|---|
| EP | 0 597 274 | 5/1994 |
| EP | 0 719 884 | 7/1996 |
| EP | 1 568 814 | 8/2005 |
| EP | 1 595 991 | 11/2005 |
| EP | 1 600 546 | 11/2005 |
| WO | 03/014453 | 2/2003 |

OTHER PUBLICATIONS

International Search Report issued in corresponding International Application No. PCT/EP2010/002193, mailed Jun. 17, 2010.

* cited by examiner

WASHING MACHINE WITH AN IMPROVED WASHING/RINSING-LIQUID INLET CIRCUIT

The present invention relates to a washing machine with an improved washing/rinsing-liquid inlet circuit.

Nowadays washing machines, both "simple" washing machines (i.e. washing machines which can only wash and rinse the laundry), and washing-drying machines (i.e. washing machines which can also dry the laundry), usually comprise an external casing provided with a loading/unloading door which allows the access to a washing tub containing a rotary perforated drum in which the laundry to be washed can be loaded.

Water and washing or rinsing products (i.e. detergents, softeners, bleaching, etc.) are admitted in the tub, and therefore in the rotating drum contained in the latter, by a water supply circuit connected to the water delivery mains present outside the machine; after the washing or rinsing phases, water is discharged from the tub by a discharge circuit.

The water supply circuit comprises a first conduit, fluidly connected, downstream, with the tub, and, upstream, with the bottom of a housing, associated to the casing, containing a removable drawer provided with various compartments adapted to be filled with washing and/or rinsing products.

The water supply circuit also comprises a water dispenser placed above the drawer and fluidly connected, upstream, typically via apposite electromagnetic inlet valves, with one or more conduits fluidly connectable to the water delivery mains.

The water dispenser is arranged in such a way that, by acting on the electromagnetic valves, it is possible to convey clean (or fresh) water, coming from the water delivery mains, to one or more compartments of the drawer, so as to flush out the products contained therein, which are in this way adducted to the bottom of the housing, and from there, via the first conduit, to the tub.

Usually the water dispenser comprises a so called "air-gap" or "air break", that is a gap, or opening, obtained in the water path present inside the water dispenser, in such a way to ensure that only a stream of water, opportunely directed, can flow through this gap towards the tub, while water can't flow, through this gap, from the tub to the water delivery mains (as could instead happen, for example in case of fault of the draining circuit, if no air-gap is provided).

A washing machine of this kind is illustrated, for example, in the European Patent n. EP 0 597 274, which disclosed a clothes washing machine, in particular of the household type, comprising a washing tub, a drum for holding the washload, a water inlet conduit from the water supply mains, an electromagnetic valve provided in the inlet conduit, a first offshoot conduit, placed downstream the electromagnetic valve, which conveys the water from the water supply mains into a laundering product dispenser through an air break; the dispenser is placed above a plurality of compartments adapted for holding washing and rinsing agents and communicating with a siphon, placed between the compartments and the washing tub, via a conduit that conveys towards the siphon the water mixed with the washing or rinsing agents which flows out of the compartments.

This washing machine also comprises a second water offshoot conduit, provided with a respective air break and situated between the electromagnetic valve and the air gap, which flows into the conduit connecting the compartments and the siphon. The air break is constituted by an interruption obtained by means of an injector located in a vertical descending section of the second offshoot conduit; the water issuing from the injector flows into the conduit.

This washing machine has however the drawback that it doesn't guarantee the possibility to obtain the wetting of the laundry with clean water before the adduction of the water mixed with washing agents into the tub. In fact, since the second offshoot conduit flows into the conduit connecting the compartments and the siphon, even if the second offshoot conduit would be fed with clean water, there is the possibility that this clean water, before entering the tub, would mix with washing and/or rinsing products which remain in the conduit or in the siphon.

The wetting of the laundry with clean water before the adduction of the washing agents would be however desirable, because the effect of the washing agents on the laundry wetted by clean water is faster and more effective. Moreover the presence of the second offshoot circuit increases the complexity of the washing machine, and causes also encumbrance problems (e.g. less space for other components inside the external casing of the washing machine, difficulty to fulfil external dimensions restrictions, etc.).

European patent n. EP 1 568 814 discloses a detergent dispenser for a washing machine comprising a box shaped recess and a washing agent drawer slidably mounted in the recess; the drawer is provided with a plurality of separate compartments for containing wash and/or rinse products to be flushed by an incoming water flow into the tub of the washing machine. Once the water has passed through the compartments, the mixture of water and washing agent passes through openings placed in the rear portion of the drawer, and is carried to the rear portion of the recess, and then to an opening for discharge into the tub of the machine.

In order to avoid the build-up of detergent residuals on the front and bottom portion of the recess, the latter is provided, on its bottom surface, on a side thereof, with a channel presenting a feeding end portion, fed by the water distributor device, and a second end curved portion which directs the water flow towards the front and bottom portion of the recess; the fresh water fed to the end portion of the channel is therefore guided to the front and bottom portion of the recess, cleaning this portion from detergent residuals.

Also in this case there is however the drawback that there isn't the guarantee to be able to obtain the wetting of the laundry with clean water before the adduction of the water mixed with washing agents into the tub; in fact the channel for the fresh water flows into the front and bottom portion of the recess, where there could be detergent residuals which could mix with the fresh water.

European patent n. EP 0 719 884 discloses a washing machine provided with a washing-agent flushing-in mechanism comprising at least one fresh water inlet, a downstream free air path, a water-conducting channel for feeding fresh water into a washing agent chamber and a fresh water branch duct connected to the channel downstream of the free air path with respect to the flow direction through the inlet air path and channel. The branch duct is connected to the water-conducting channel for a preliminary washing agent chamber, which is in turn fluidly connected to the washing tub. The machine has a frontal loading door with a window and the branch duct is connected to a nozzle directed from above onto an inward surface of the window.

Also this washing machine has however a drawback; in fact the branch duct is fluidly connected to the preliminary washing agent chamber, and the adduction of fresh water to the branch duct involves always the adduction of fresh water also to the preliminary washing agent chamber, in which there could be detergent residuals which could be flowed into the tub by the fresh water. It isn't therefore possible to supply only fresh water to the branch duct, and therefore also in this case there isn't the guarantee to be able to wet the laundry only with fresh water before the adduction of the water mixed with washing agents into the tub.

Furthermore, the presence of the branch duct increases the complexity of the washing machine, and causes also encumbrance problems.

An aim of the present invention is therefore to obtain a washing machine which allows introducing selectively in the tub clean or fresh water without the risk that the latter would come into contact with washing or rinsing agent before entering the tub, and reducing at the same time, with respect to the prior art, the complexity and the encumbrance of the circuit for the adduction of water and/or detergents to the tub.

Within this aim, another object of the present invention is to reduce the costs for assembly of the circuit for the adduction of water and/or detergents to the tub.

It is therefore an object of the present invention to solve the above-noted problems, thereby doing away with the drawbacks of the cited prior art.

The Applicant has found that by the use of a water line comprising one or more single-piece elements comprising a first conduit, fluidly connecting the compartments of a drawer of a washing machine adapted to be filled with washing and/or rinsing products, and comprising also a second conduit, fluidly separated from the first conduit, fluidly connectable, upstream, with a water source, and fluidly connected, downstream, with the tub, the first and second conduits being obtained in single-piece construction, it is possible to selectively introduce in the tub clean or fresh water without the risk that the latter would come into contact with a washing or rinsing agent before entering the tub, reducing as well the complexity and the encumbrance of the circuit for the adduction of water and/or detergents to the tub with respect to the prior art.

In particular, the above-mentioned aim and objects, as well as others that will become better apparent hereinafter, may be achieved by a washing machine comprising:

- a washing tub containing a rotary perforated drum;
- a washing/rinsing-liquid dispenser, fluidly connectable to a water source, comprising a housing and a drawer, removably associated to the housing, provided with one or more compartments adapted to be filled with washing and/or rinsing products;
- a water line fluidly connecting the washing/rinsing-liquid dispenser and the tub.

The water line comprises one or more single-piece elements comprising a first conduit, fluidly connecting the one or more compartments and the tub, and a second conduit, fluidly separated from the first conduit, fluidly connectable, upstream, with the water source, and fluidly connected, downstream, with the tub, the first and second conduits being provided in a single-piece construction.

Advantageously the water line comprises two or more single-piece elements, connected in series in such a way that their first conduits are fluidly connected one another, and that their second conduits are fluidly connected to one another.

In a further embodiment, two contiguous single-piece elements are watertightly fixed to one another.

Preferably, two contiguous single-piece elements are watertight fixed to one another by welding, and/or by gluing, and/or by joint. Opportunely between two contiguous single-piece elements there is a sealing element.

Opportunely between two contiguous single-piece elements there is a sealing element.

In a further embodiment, at least one single-piece element is obtained in a single-piece construction with the housing.

In a further embodiment, at least one single-piece element is fixed to the housing by welding and/or gluing, and/or joint.

In a further embodiment, at least one single-piece element is fixed to the housing by welding and/or gluing, and/or joint.

Opportunely, the second conduit of at least one single-piece element is provided with an outlet arranged in such a way that a jet of clean or fresh water exiting from this outlet is oriented towards an upper central region of the rotary perforated drum. Advantageously one single-piece element is connected, downstream, to a flexible bellows, connecting the tub and an access opening of the washing machine, in such a way that the outlet of the second conduit of this single-piece element is positioned substantially in the top portion of the flexible bellows.

Preferably the first conduit and the second conduit of each one of the single-piece elements are parallel one another.

Opportunely, a recirculation circuit is provided, adapted to drain the washing/rinsing-liquid from the bottom of the tub and to re-admit this re-circulated washing/rinsing-liquid into an upper region of the tub; the recirculation circuit is fluidly connected to the second conduit of one of the one or more single-piece elements, in such a way that the re-circulated washing/rinsing-liquid is admitted into the tub via the second conduit.

Advantageously the second conduit of at least one of the one or more single-piece elements is fluidly connected, upstream, to a by-pass line, obtained in the washing/rinsing-liquid dispenser and fluidly connectable, upstream, to the water source, in such a way that a flow of fresh or clean water can flow from the by-pass line to the second conduit.

Features and advantages of the present invention will anyway be more readily understood from the description that is given below by way of non-limiting example with reference to the accompanying drawings, in which.

Figure 1:
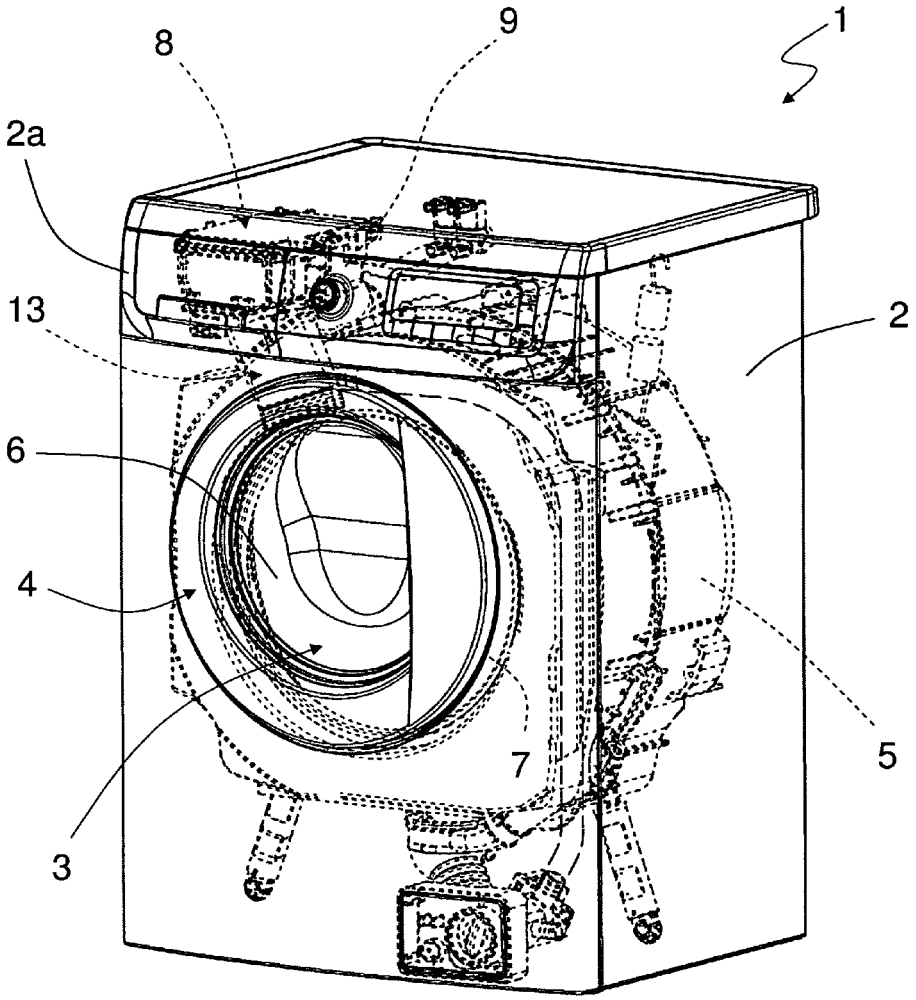
FIG. 1 is a schematic view of a washing machine according to the invention, in which some internal components, not visible from the outside, have been represented in dotted lines.

It is seen therefore how embodiments of the invention may achieves the proposed aim and objects, there being provided a washing machine 1 comprising an external casing 2 in which an access opening 3 is obtained, provided with a loading/unloading door 4, which allows the access to a washing tub 5, contained in the external casing 2, and containing, in turn, a rotary, perforated, drum 6 in which the laundry to be washed, not illustrated, can be loaded.

In the embodiments illustrated in the enclosed Figures, the washing machine 1 is a "simple" washing machine (i.e. a washing machine which can only wash and rinse the laundry), of the front loading type; in a further embodiment, not illustrated, of the invention, the washing machine can however be a "simple" washing machine of the top-loading type, or also a washing-drying machine (i.e. a washing machines which can also dry the laundry), both of the front-loading type and of the top-loading type.

With reference to the enclosed Figures, the tub 5 of the washing machine 1 is connected to the external casing 2 via a flexible bellows 7, interposed between the frontal, opened, surface of the tub 5 facing the access opening 3, and the border of the latter.

Advantageously, the washing machine 1 comprises a washing/rinsing-liquid dispenser 8 (i.e. a device adapted to dispense water and/or water mixed with washing or rinsing products) which comprises a box-shaped housing 9, connected to the external casing 2, internally to the latter, preferably by suitable fixing means, comprising, for example, screws or rivets, not illustrated, or also glue, or welding.

In the enclosed Figures, the housing 9 is advantageously substantially parallelepiped, and it is connected to the frontal surface 2*a* of the external casing 2, opportunely in an upper region of the latter, positioned above the tub 5.

Figure 2:
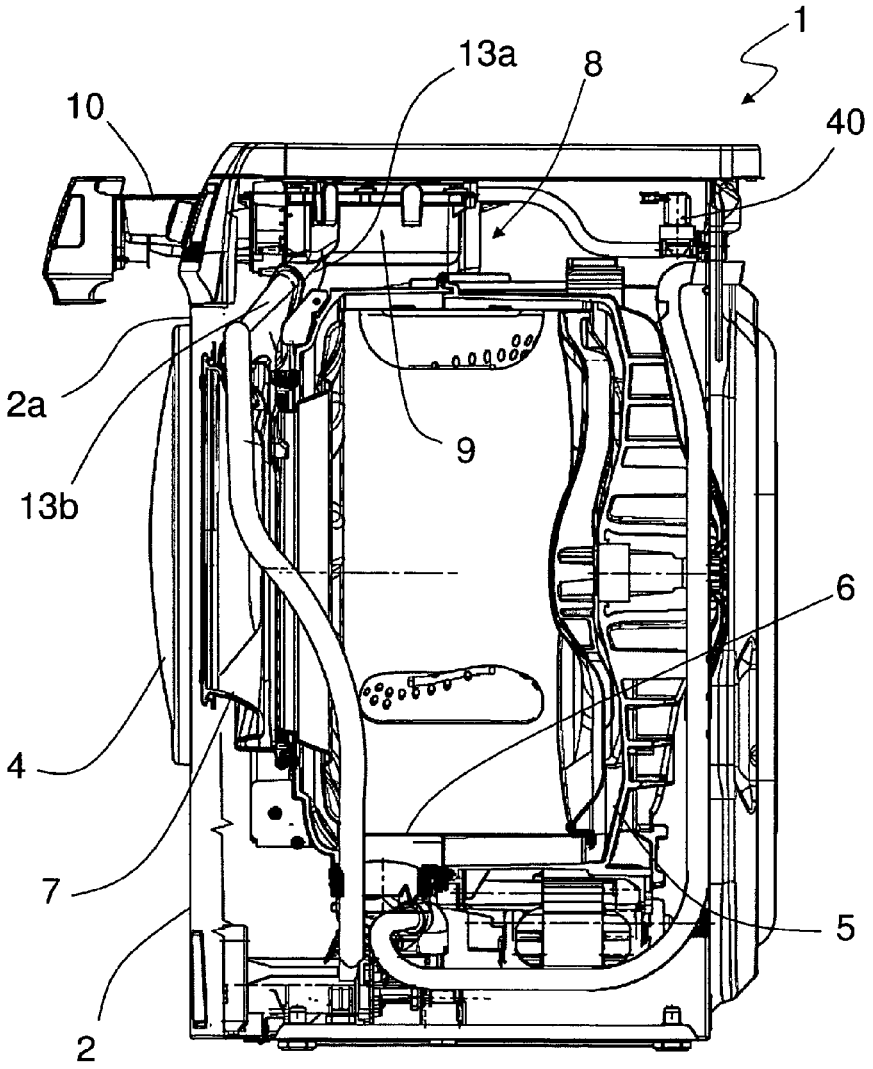
FIG. 2 is lateral view, partially sectioned, of the washing machine represented in FIG. 1.
Figure 3:
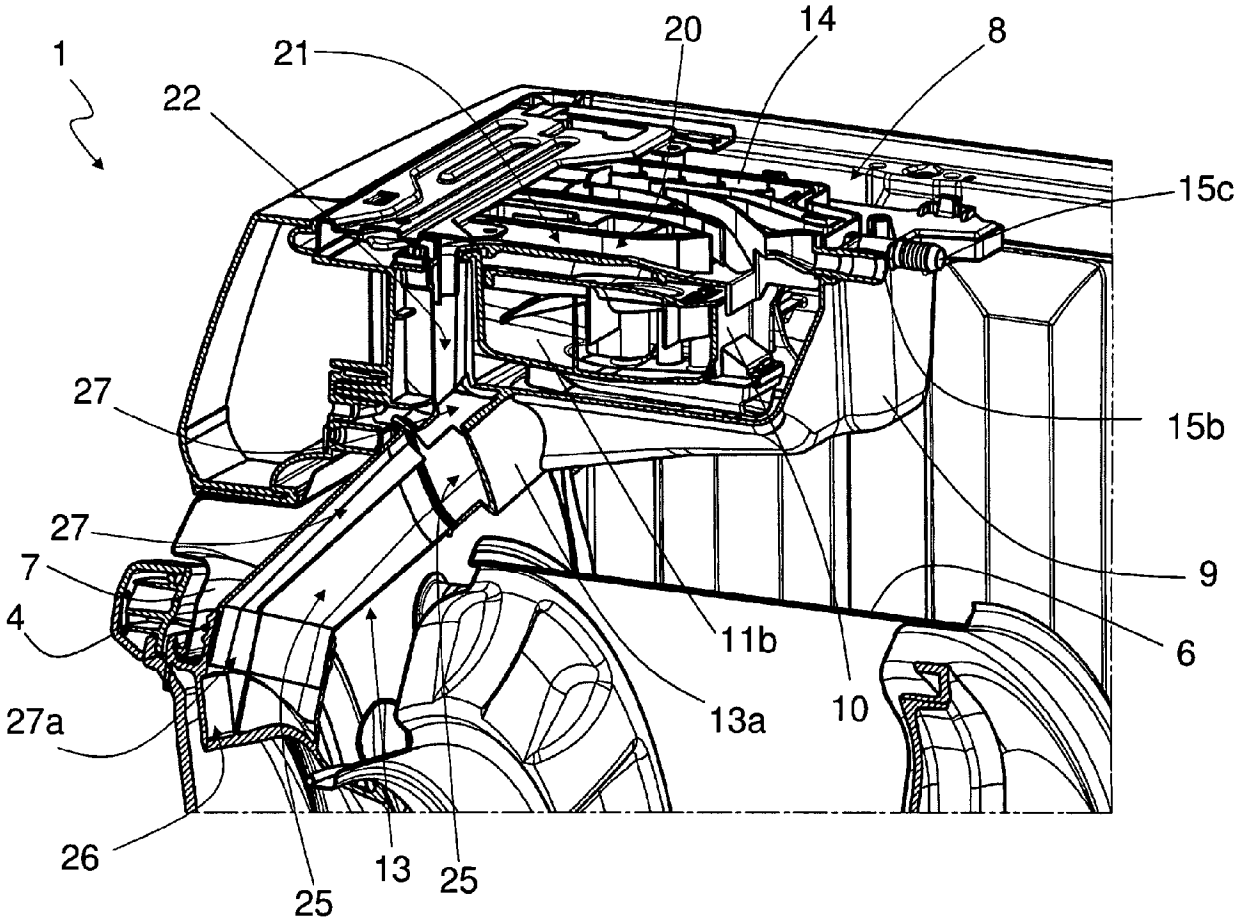
FIG. 3 is a perspective view, partially sectioned, of a particular of the washing machine illustrated in FIGS. 1 and 2.

The housing 9 contains a removable drawer 10 which can be extracted from the housing 9, such as to protrude from the external casing 2 in a loading position, illustrated for example in FIG. 2, or can be fully inserted into the housing 9 in an operative position, illustrated for example in FIGS. 1 and 3.

The drawer 10 is provided with one or more compartments 11*a*, 11*b*, adapted to be filled with washing and/or rinsing products, not illustrated, such as detergent, or softener.

Figure 4:
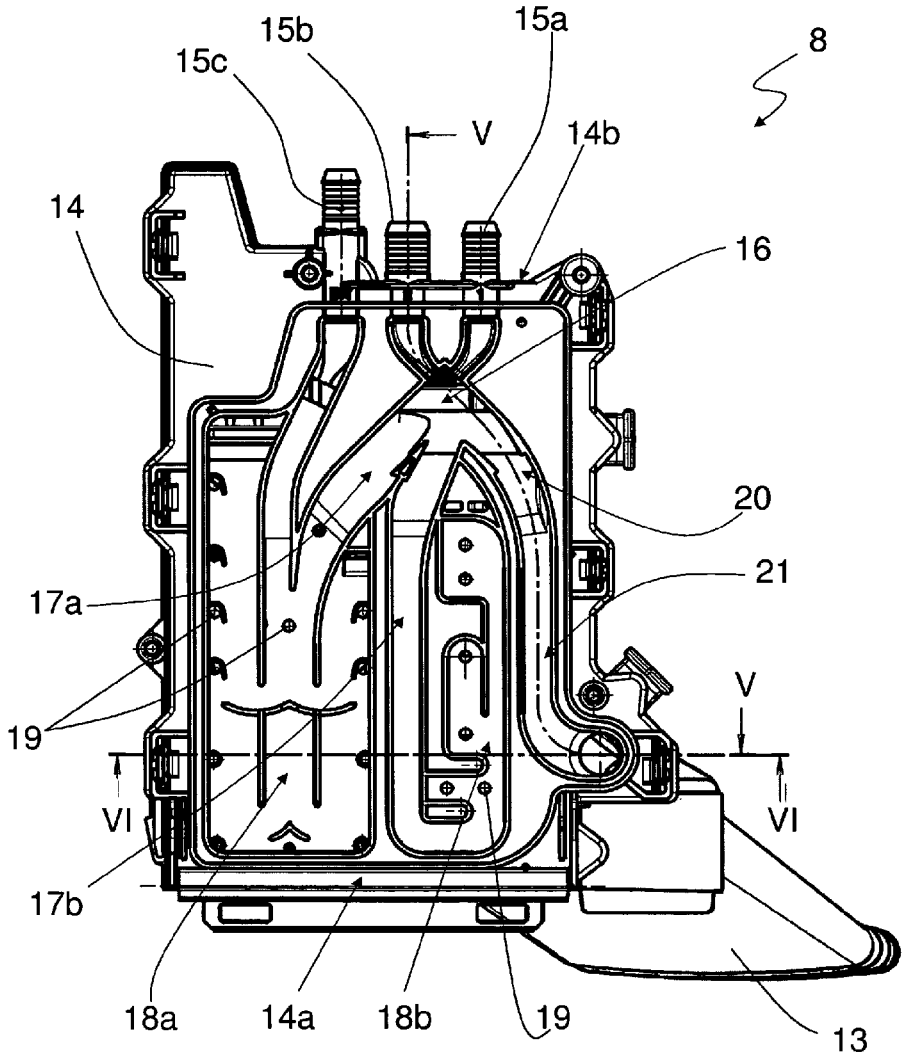
FIG. 4 is a plan view of the washing/rinsing-liquid dispenser of the washing machine represented in the previous Figures.
Figure 5:
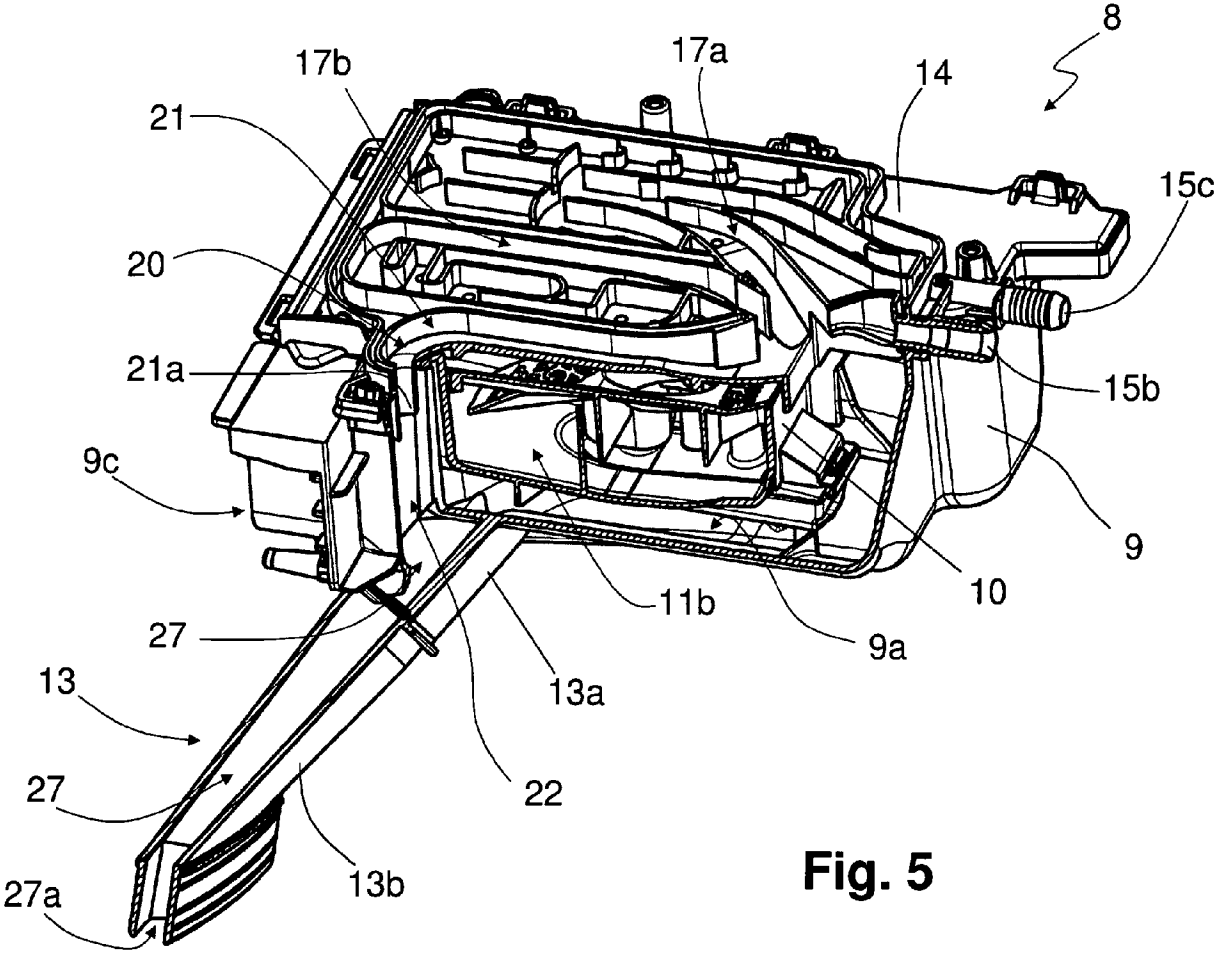
FIG. 5 is a perspective view of the washing/rinsing-liquid dispenser of FIG. 4, sectioned along plane V-V of FIG. 4.
Figure 6:
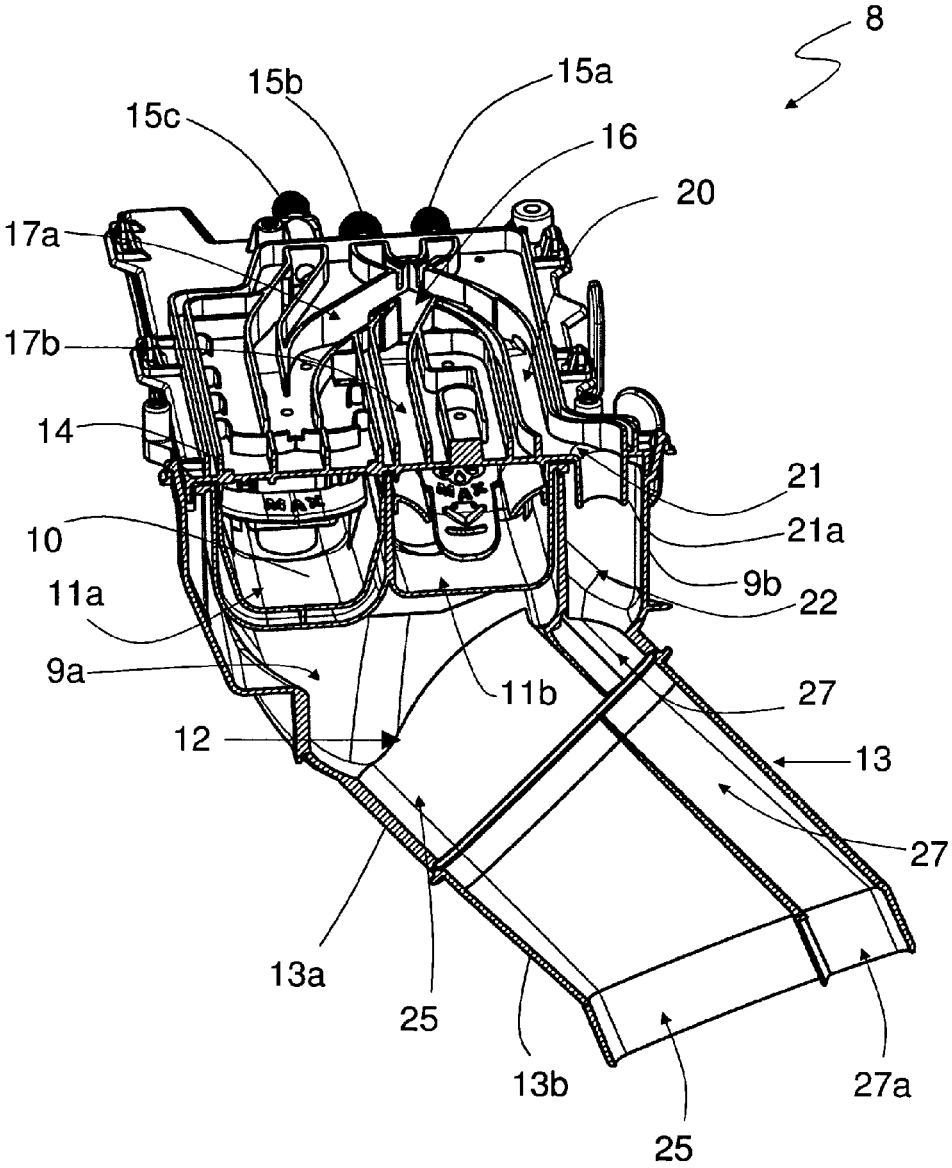
FIG. 6 is a perspective view of the washing/rinsing-liquid dispenser of FIG. 4, sectioned along plane VI-VI of FIG. 4.

In the embodiment illustrated in FIGS. 4, 5 and 6, there are two compartments, 11*a* and 11*b*, one adapted for receiving a detergent for washing the laundry, and the other adapted to receive a softener; in another embodiment, not illustrated, there could be for example another compartment, adapted, for example, to be filled with a pre-wash detergent.

The compartments 11*a*, 11*b* are fluidly connected to the bottom 9*a* of the housing 9, particularly to the frontal portion of this bottom 9*a*, in which an outlet port 12 is obtained, adapted to allow the flowing of a liquid into a water line 13, which will be described in the following, fluidly connecting the washing/rinsing-liquid dispenser 8 and the tub 5.

It is underlined that in the present application saying that a first component is "fluidly separated" from a second component means that a fluid can't flow from the first component to the second component or vice versa; on the contrary, saying that a first component is "fluidly connected" to a second component means that a fluid can flow from the first component to the second component and vice versa.

Advantageously, the washing/rinsing-liquid dispenser 8 comprises a water distributor 14, associated to the housing 9 and placed above the drawer 10 in such a way to allow the flowing of water to the one or more compartments 11*a*, 11*b*.

Advantageously, the water distributor 14 comprises two or more inlet connectors 15*a*, 15*b*, connectable, upstream, to a water source which could comprise, for example, the plumbing of the building in which the washing machine 1 is installed.

It is underlined that in the present application the terms "upstream" and "downstream" to the flowing direction of a liquid during the standard functioning of the washing machine; for example saying that a first component is fluidly connected, upstream, to a second component, means that in the standard functioning of the washing machine a fluid enters firstly the second component, and then the first component; saying that a first component is fluidly connected, downstream, to a second component, means that in the standard functioning of the washing machine a fluid enters firstly the first component, and then the second component.

Advantageously the inlet connectors 15*a* 15*b* can be connected to the water source via controllable valves 40, preferably of the electromagnetic type, opportunely controlled by an electronic control device, also not illustrated, adapted to control the operations of the washing machine 1. In the embodiments illustrated in the enclosed Figures, there are two inlet connectors 15*a*, 15*b*; each inlet connector 15*a*, 15*b* can be connected, via a dedicated controllable valve 40, to a water source for the adduction of cold water.

In the embodiment illustrated in the enclosed Figures there is also a further inlet connector 15*c* connectable, upstream, via a dedicated controllable valve, to a water source; the further inlet connector 15*c* can be fed with warm or hot water, for example obtained by a solar thermal collector; in a further embodiment, not illustrated, there could be more than one further inlet connectors, connected to one or more water sources.

Advantageously, the inlet connectors 15*a*, 15*b* are fluidly connected, downstream, to an "air-gap" or "air break" 16, from which at least two ducts 17*a*, 17*b* branch off, fluidly connected to the inlet connectors 15*a*, 15*b*, and each one fluidly communicating with a different region 18*a*, 18*b* of the water distributor 14 which is positioned in such a way to be placed above a different compartment 11*a*, 11*b* of the drawer 10 when the latter is placed in the above mentioned operative position; the regions 18*a* and 18*b* of the water distributor 14 are provided with one or more apertures 19, adapted to allow the passage of the water from the ducts 17*a*, 17*b*, to the underlying compartment 11*a*, 11*b*.

As will be better explained in the following, by acting on the controllable valves, it is possible to selectively feed one or the other duct 17*a* or 17*b* with water coming from the water source.

In another embodiment, not illustrated, in the drawer 10 there are more than two compartments, and in the water distributor 14 there is an equal number of ducts, each one fluidly communicating with a different region of the water distributor 14 which is positioned in such a way to be placed above a different compartment of the drawer 10 when the latter is placed in the above mentioned operative position; also in this case, by acting on the controllable valves, it is possible to selectively feed a desired duct with water coming from a water source.

In the embodiments illustrated in the enclosed Figures also the further connector 15*c*, which can be fed with warm or hot water, for example obtained by a solar thermal collector, is fluidly connected to the region 18*a* of the water distributor 14, in such a way to adduct also warm or hot water in the underlying compartment 11*a*.

Advantageously the washing/rinsing-liquid dispenser 8 also comprises a by-pass line 20, fluidly connected, upstream, to at last one of the inlet connectors, opportunely extending (i.e. spreading, generating) substantially from the air-gap or air-break 16, and fluidly separated from the compartments 11*a*, 11*b*; the by-pass line is also adapted to allow the flow of clean (or fresh) water from the water distributor 14 to the tub 5, through the washing/rinsing-liquid dispenser 8.

The fact that the by-pass line 20 is fluidly separated from the compartments 11*a*, 11*b* means that the by-pass line 20 is arranged in such a way that a flow of clean (or fresh) water, coming from one or more of the inlet connectors 15*a*, 15*b* and trespassing the air-gap or air-break 16, can enter the by-pass line 20 without entering one of the ducts 17*a*, 17*b*.

As will be better explained in the following, by acting on the controllable valves 40 associated to the inlet connectors 15*a*, 15*b*, it is possible to feed the by-pass line 20 with the water coming from the water source.

In the embodiment illustrated in the enclosed Figures, by opening only the controllable valve 40 connected to the inlet connector 15*b*, a flow of clean or fresh water enters the water distributor 14, goes across the air-gap 16, and enters the by-pass line 20.

The by-pass line 20 provides therefore, through the washing/rinsing-liquid dispenser 8, a passage for the clean or fresh water coming from the water delivery mains and directed to the tub 5, ensuring that this water doesn't enter into contact with the detergent or with the softener which could be present in the washing/rinsing-liquid dispenser 8.

Advantageously, as it will be better explained in the following, the bypass line 20 comprises a first conduit portion 21, obtained in a region of the water distributor 14 not occupied by the ducts 17*a* and 17*b*, and fluidly connected, upstream, to one or more of the inlet connectors 15*a*, 15*b*; the first conduit portion 21 is opportunely fluidly separated from the compartments 11*a*, 11*b*.

Advantageously, the first conduit portion 21 comprises also a tubular portion 21*a* protruding towards the underlying drawer 9; clearly the tubular portion 21*a* could also be not provided.

Opportunely the by-pass line 20 also comprises a second conduit portion 22 fluidly connected, upstream, to the overlaying first conduit portion 21; the second conduit portion 22 is fluidly connected, downstream, to the tub 5, and it is fluidly separated from the compartments 11*a*, 11*b*.

In a first embodiment, illustrated in FIGS. 1 to 6, the first conduit portion 21 extends (i.e. spreads, emanates) substantially from the air-gap or air-break 16 and it extends substantially longitudinally along the water distributor 14, almost up to the frontal end 14*a* of the water distributor 14. In this case the second conduit portion 22 is advantageously provided in/at a lateral wall 9*b* of the housing 9, opportunely near to the frontal end 9*c* of the housing 9 opposite to the inlet connectors 15*a*, 15*b*.

Advantageously, the second conduit portion 22 illustrated in the embodiment of FIGS. 1 to 6 is obtained along an axis, not illustrated, substantially perpendicular to the bottom 9*a* of the housing 9.

Advantageously, in the embodiment illustrated in FIGS. 1 to 6 the second conduit portion 22 is obtained in a single-piece construction with the housing 9, in such a way to be fluidly separated from the compartments 11*a*, 11*b*.

In a further embodiment, not illustrated, the second conduit portion 22 can be comprised in a suitable external element (for example a pipe or tube), not illustrated, fixed to the lateral wall 9*b* of the housing 9, for example by gluing or welding or joint.

Figure 7:
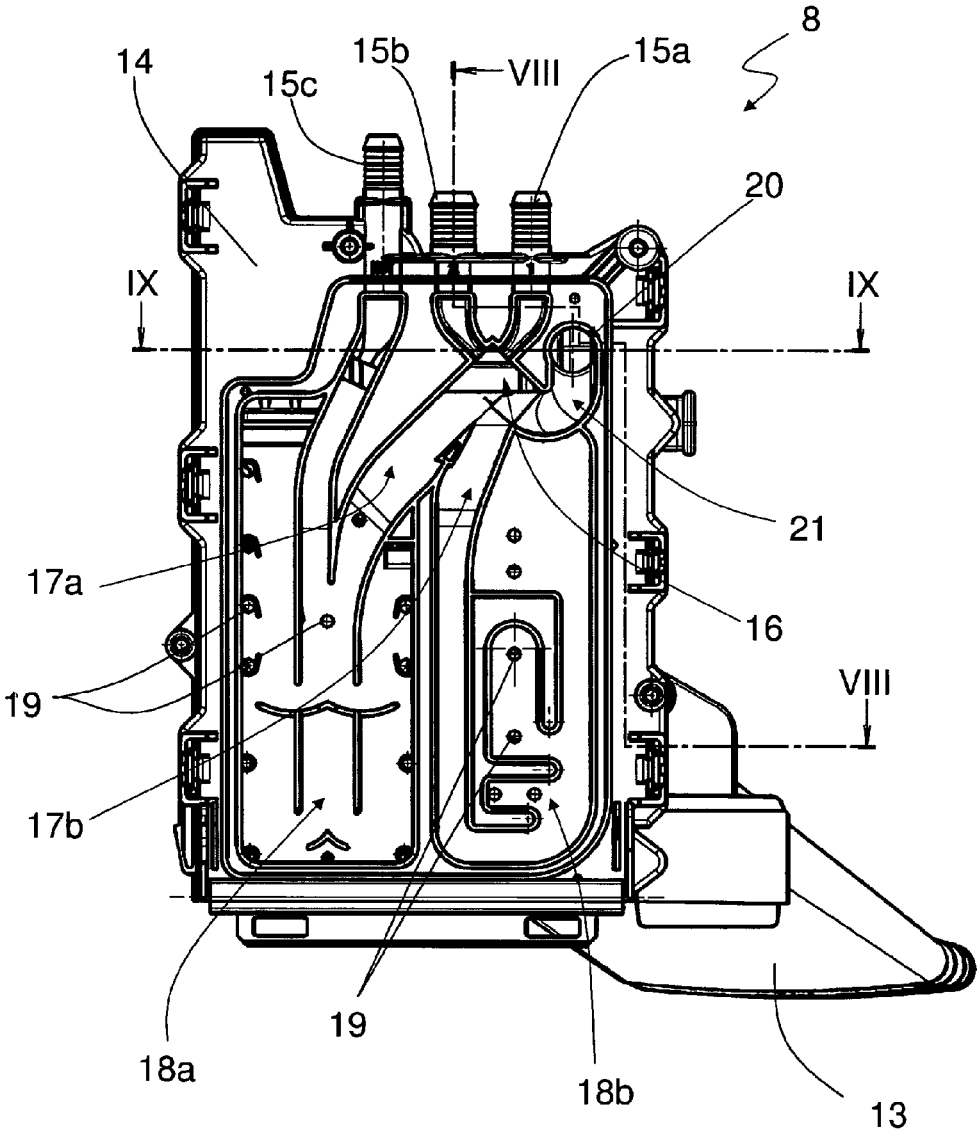
FIG. 7 is a plan view of a second embodiment of a washing/rinsing-liquid dispenser of a washing machine according to the invention.
Figure 8:
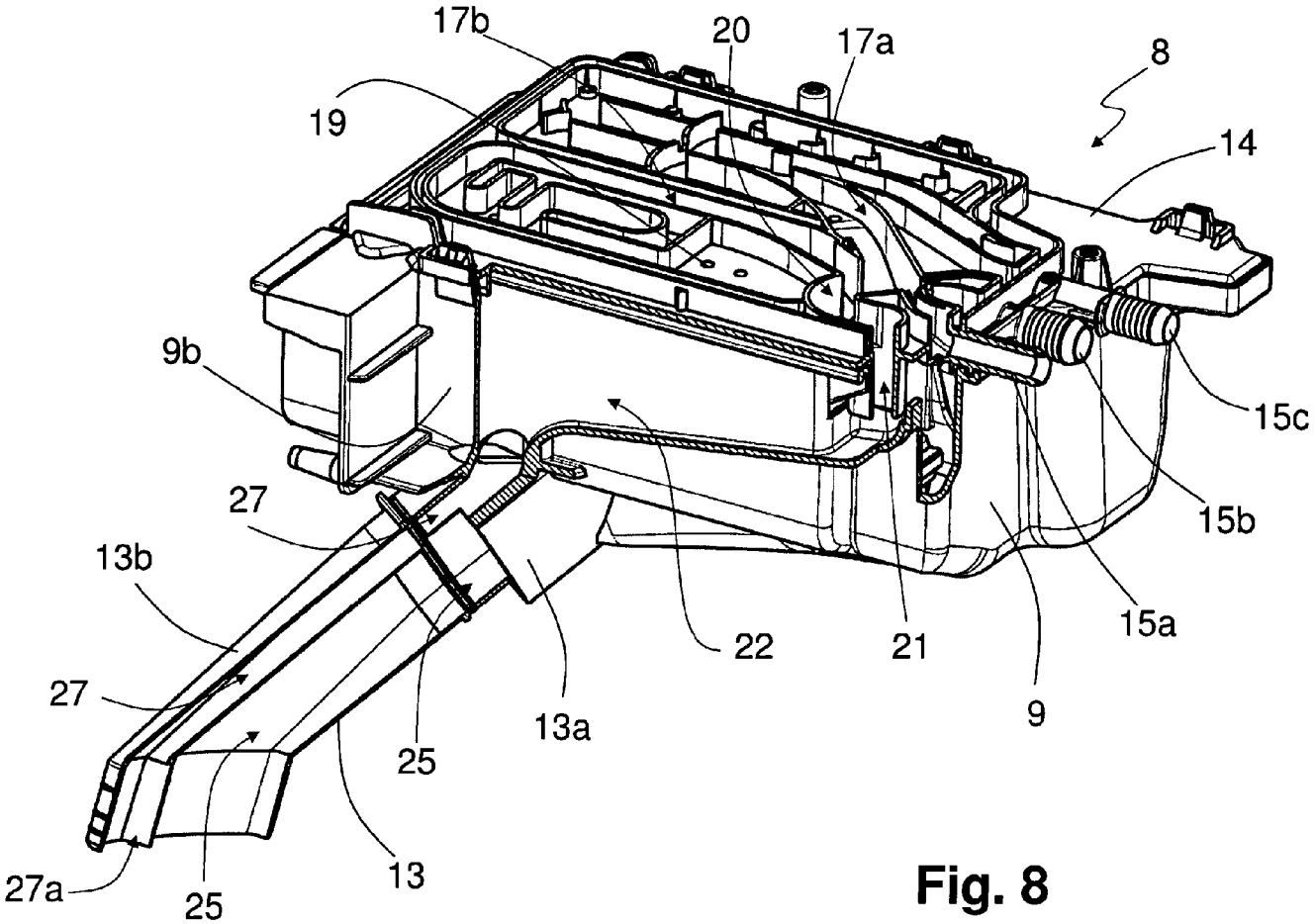
FIG. 8 is a perspective view of the washing/rinsing-liquid dispenser of FIG. 7, sectioned along plane VIII-VIII of FIG. 7.
Figure 9:
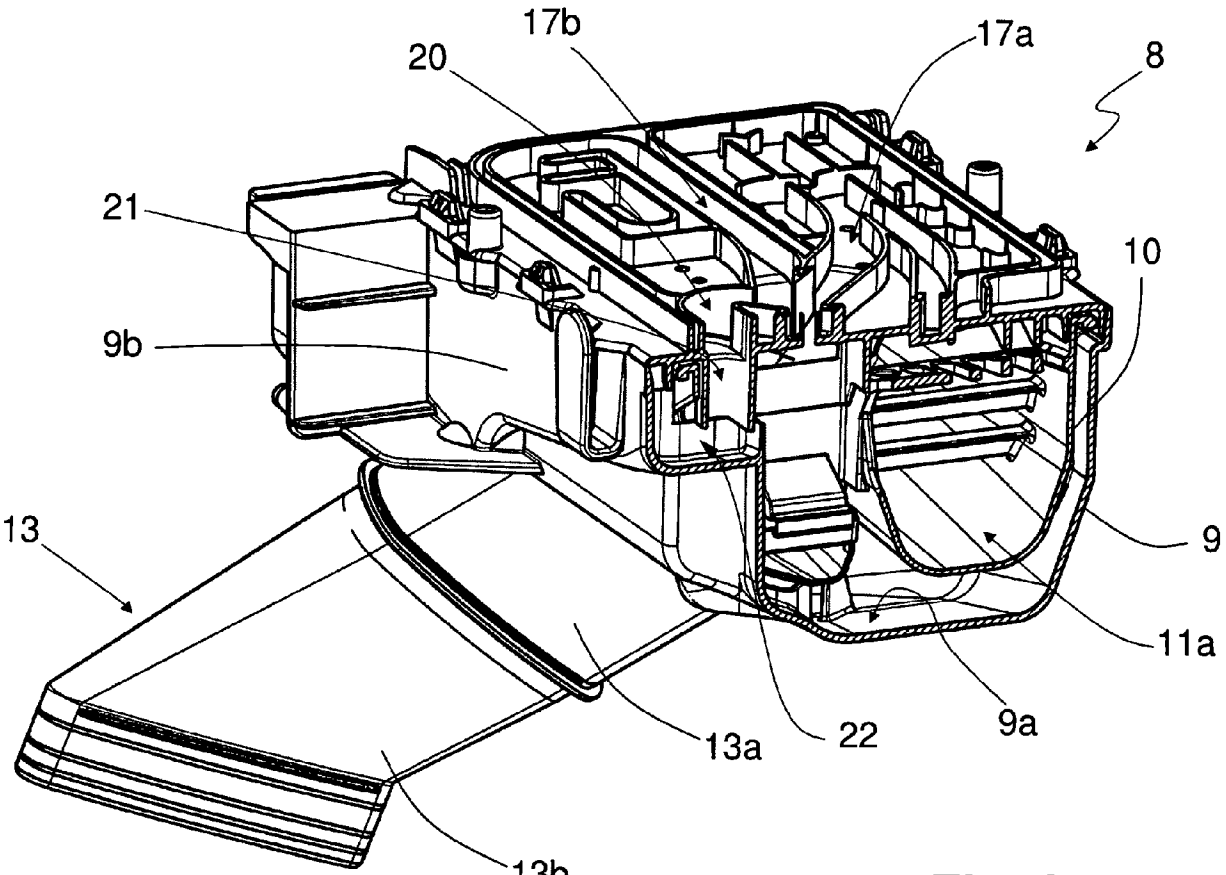
FIG. 9 is a perspective view of the washing/rinsing-liquid dispenser of FIG. 7, sectioned along plane IX-IX of FIG. 7.
Figure 10:
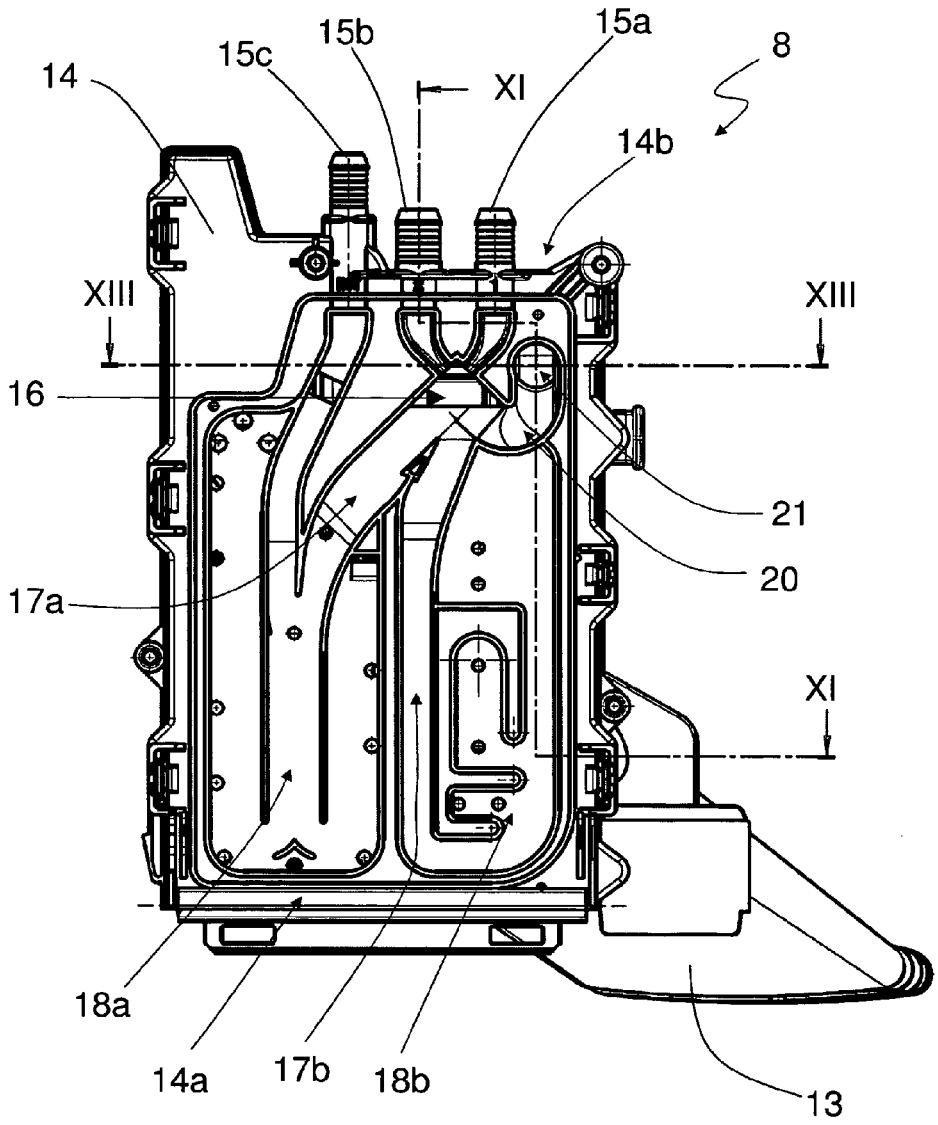
FIG. 10 is a plan view of a third embodiment of a washing/rinsing-liquid dispenser of a washing machine according to the invention.

In a second embodiment, illustrated in FIGS. 7 to 9, the first conduit portion 21 is very short, and extends preferably towards the rear end 14*b* of the water distributor 14. Also in this case the first conduit portion 21 advantageously comprises also a tubular portion 21*a* protruding towards the underlying drawer 9; clearly the tubular portion 21*a* could also be not provided.

Opportunely, as indicated in FIG. 7, in this second embodiment the first conduit portion 21 is, in a plan view, substantially semicircular.

Advantageously, also in this second embodiment the second conduit portion 22 is provided in/at a lateral wall 9*b* of the housing 9; in this case the second conduit portion 22 extends longitudinally along the lateral wall 9*b* of the housing 9.

Advantageously, also in the embodiment illustrated in FIGS. 7 to 9 the second conduit portion 22 is obtained in a single-piece construction with the housing 9, in such a way to be fluidly separated from the compartments 11*a*, 11*b*.

In a further embodiment, not illustrated, the second conduit portion 22 can be Comprised in a suitable external element (for example a pipe or tube), not illustrated, fixed to the lateral wall 9*b* of the housing 9, for example by gluing or welding or joint.

In a third embodiment, illustrated in FIGS. 10 to 15, the first conduit portion 21 is, in a plan view, substantially analogous to the one illustrated in FIGS. 7 to 9, and comprises also a tubular portion 21*a* protruding towards the underlying drawer 9.

Advantageously, but not necessarily, the tubular portion 21*a* can be obtained in a single-piece construction with the water distributor 14.

Figure 11:
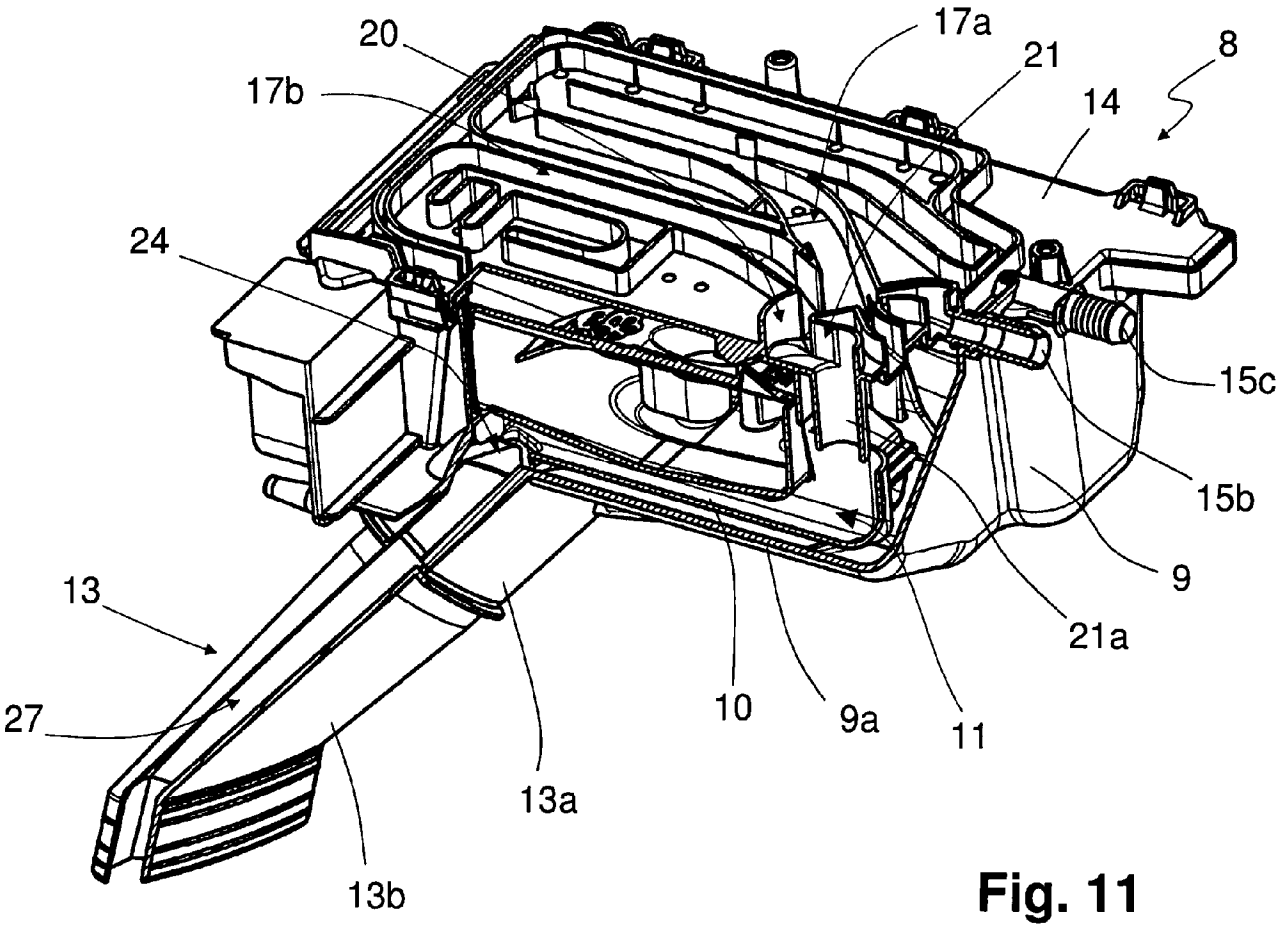
FIG. 11 is a perspective view of the washing/rinsing-liquid dispenser of FIG. 10, sectioned along plane XI-XI of FIG. 10.
Figure 12:
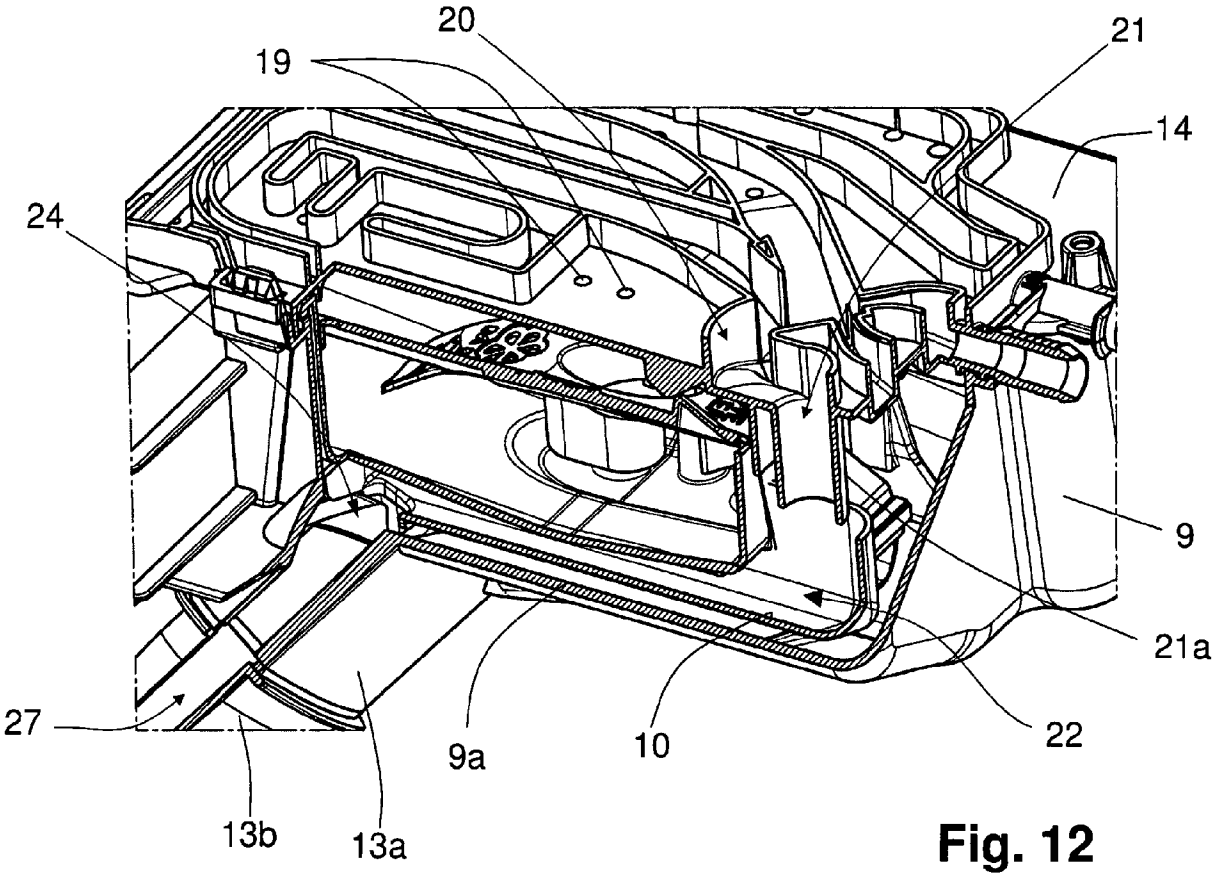
FIG. 12 is an enlarged particular of FIG. 11.
Figure 13:
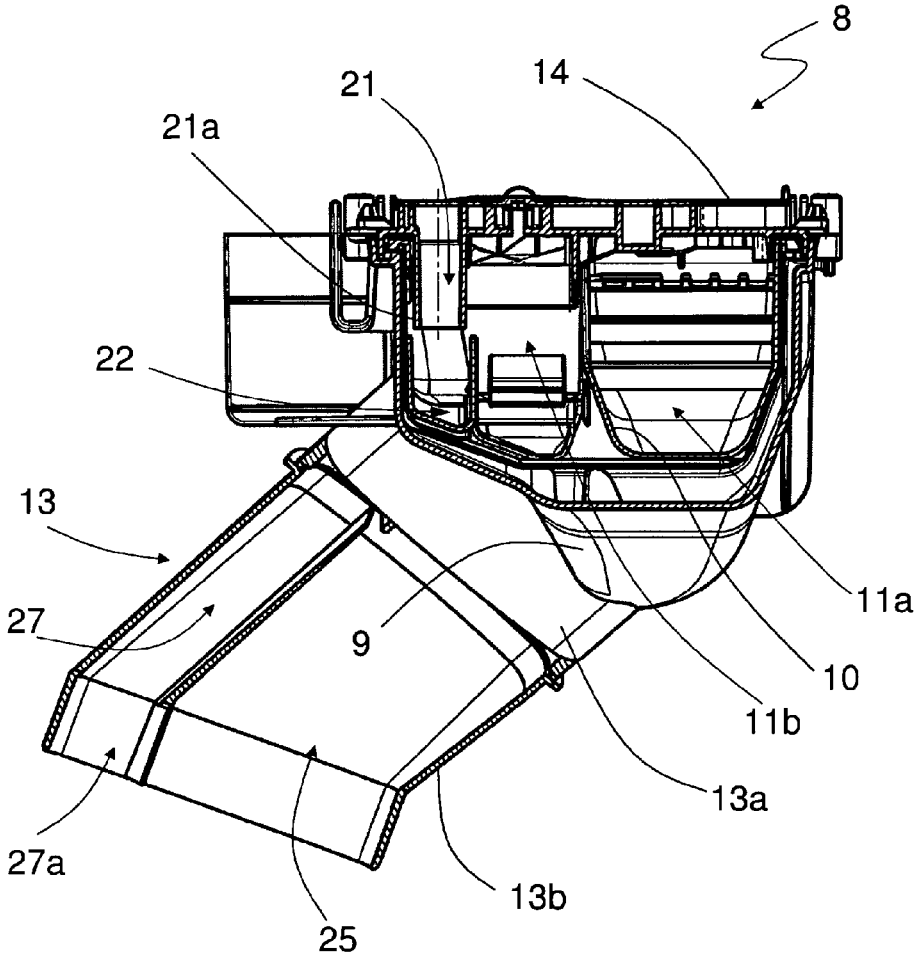
FIG. 13 is a perspective view of the washing/rinsing-liquid dispenser of FIG. 10, sectioned along plane XIII-XIII of FIG. 10.
Figure 14:
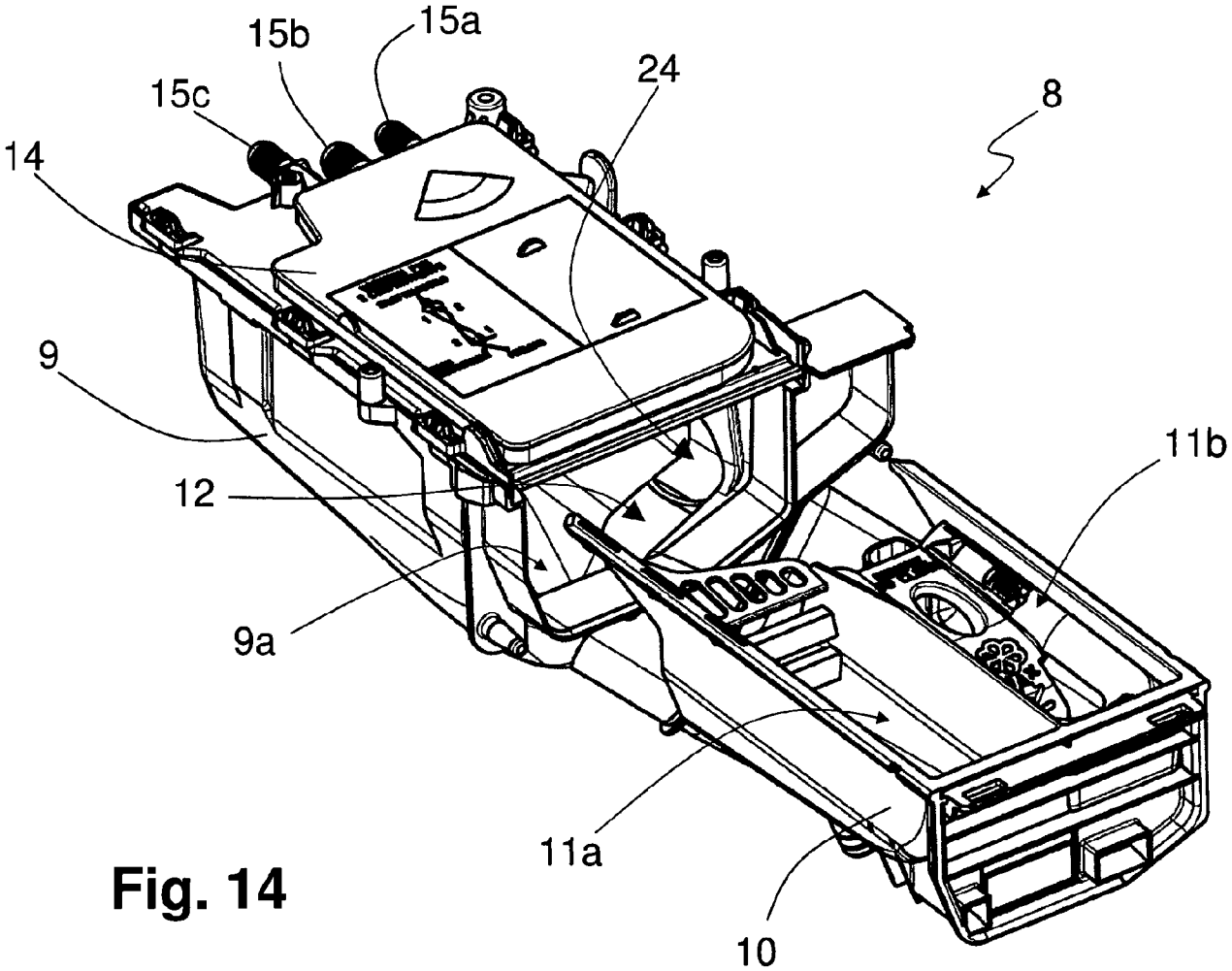
FIG. 14 is a first perspective and exploded view of the washing/rinsing-liquid dispenser of FIG. 10.
Figure 15:
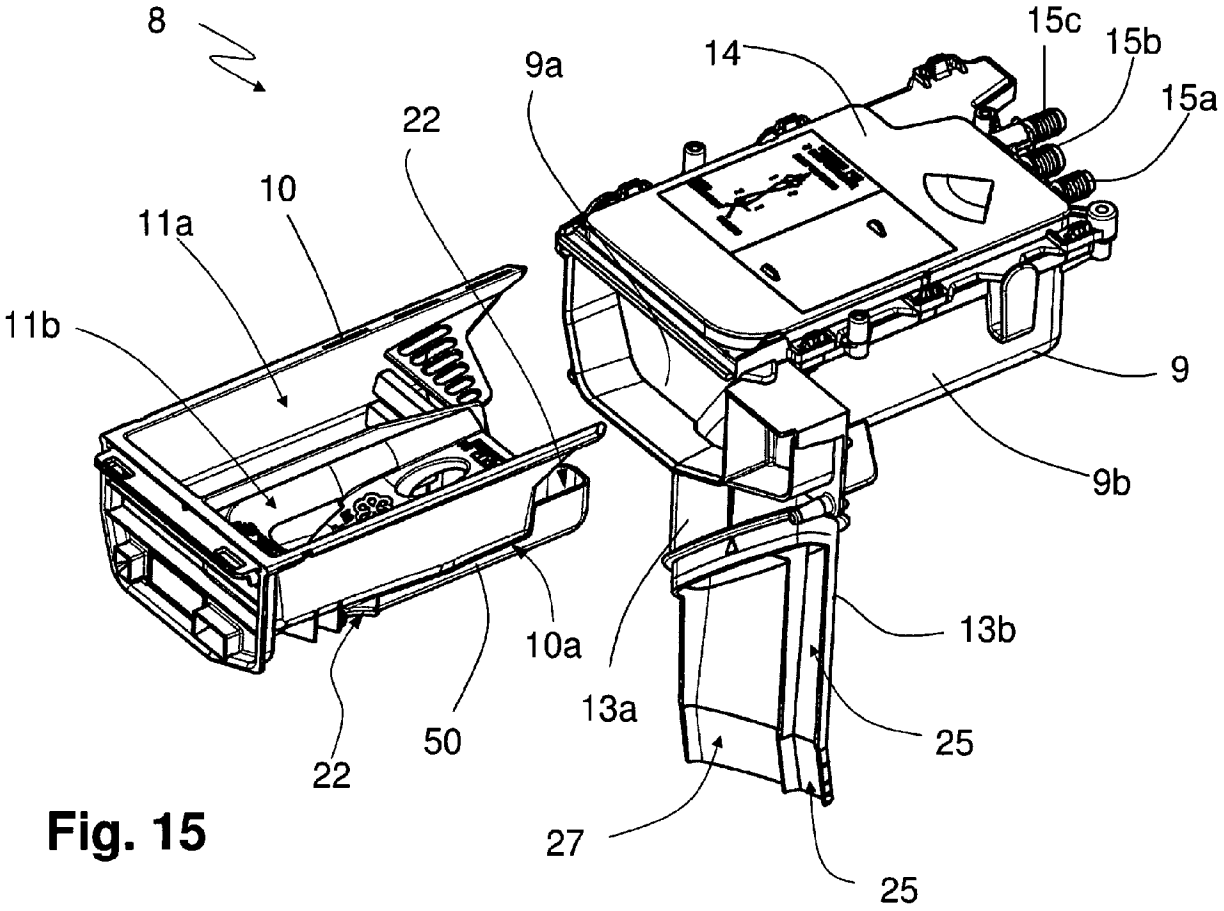
FIG. 15 is a second prospective perspective and exploded view of the washing/rinsing-liquid dispenser of FIG. 10.

In this third embodiment the second conduit portion 22 is provided in/at the drawer 10 and is arranged in such a way to be fluidly connected, upstream, when the drawer 10 is in the operative position, illustrated for example in FIGS. 11 and 12, to the tubular portion 21*a* of the first conduit portion 21, and downstream to the tub 5.

In the embodiment illustrated in FIGS. 10 to 15, the second conduit portion 22 is obtained between the bottom 10*a* of the drawer 10 and an external tray 50, fixed to said bottom 10*a*; in a further embodiment, not illustrated, the second conduit portion 22 is obtained in a single-piece construction with the drawer 10, in such a way that this second conduit portion 22 is fluidly separated from the compartments 11*a*, 11*b*.

In this third embodiment the second conduit portion 22 is fluidly connected, downstream, to the water line 13 via a suitable aperture 24 obtained in the housing 9 and fluidly separated from the outlet port 12.

The aperture 24 is arranged in such a way that it is dedicated for the flowing of clean or fresh water coming from the second conduit portion 22; in the embodiment illustrated in FIGS. 10 to 15, the aperture 24 is advantageously obtained in the housing 9 in a position higher than the outlet port 12, in such a way that a liquid present in the bottom 9*a* of the housing 9 can enter in the outlet port 12, but not in the aperture 24.

Obviously the first conduit portion 21 obtained in the water distributor 14, can have substantially any configuration (provided that it is obtained in a region of the water distributor 14 not occupied by the ducts 17*a* and 17*b*, that it is fluidly connected, upstream, to one or more of the inlet connectors 15*a*, 15*b*, and that it is fluidly separated from the compartments 11*a*, 11*b*).

Alike, the second conduit portion 22 can be obtained only in the housing 9, partially in the housing 9 and partially in the drawer 10, or totally in the drawer 10, and it can have any shape (provided that it is fluidly connected, upstream, to the overlaying first conduit portion 21, fluidly connected, downstream, to the tub 5, and fluidly separated from the compartments 11*a*, 11*b*).

In all the above mentioned embodiments, therefore, the by-pass line 20 obtained in the washing/rinsing-liquid dispenser 8 is fluidly separated from the compartments 11*a*, 11*b*, and allows the flowing, towards it, of a flow of fresh or clean water coming from a controllable valve connectable to a water source.

Advantageously, at least one of the one or more single-piece elements can be obtained in a single-piece construction with the housing 9; alternatively, at least one of the one or more single-piece elements can be fixed to the housing, preferably by welding and/or gluing, and/or joint.

For example, in the embodiments illustrated in the enclosed Figures, the water line 13 comprises two single-piece elements 13*a*, 13*b*, connected in series in such a way that their first conduits 25 are fluidly connected to one another, and their second conduits 27 are fluidly connected to one another.

Opportunely, but not necessarily, the first and second conduits of a single-piece element are substantially parallel one another.

Advantageously, at least one of the one or more single-piece elements can be obtained in a single-piece construction with the housing 9; alternatively, at least one of the one or more single-piece elements can be fixed to the housing, preferably by welding and/or gluing, and/or joint.

For example, in the embodiments illustrated in the enclosed Figures, the water line 13 comprises two single-piece elements 13*a*, 13*b*, connected in series in such a way that their first conduits 25 are fluidly connected one another, and their second conduits 27 are fluidly connected one another.

In these embodiments the single-piece element 13*a* is opportunely obtained in a single-piece construction with the housing 9, and it is fluidly connected, downstream, with a single-piece element 13*b* which is in turn connected, downstream, to a suitable opening 26 obtained preferably in an upper region of the bellows 7.

The second conduit 27 of the single-piece element 13*a* is opportunely fluidly connected to the by-pass line 20, downstream of the latter, in such a way that clean or fresh water can flow from the by-pass line 20 to the second conduit 27.

Advantageously, the outlet 27*a* of the second conduit 27 of the single-piece element 13*b* is arranged in such a way that the flow of clean or fresh water exiting from it is oriented towards the upper central region of the rotary perforated drum 6; this can be obtained by a proper shaping of the outlet 27*a*, or by a suitable nozzle, not illustrated, fluidly connected to the outlet 27*a*, or by a suitable design of the bellows 7 or of the opening 26 obtained in the latter.

In the example illustrated in the enclosed Figures, the outlet 27*a* of the second conduit 27 of the single-piece element 13*b* is positioned substantially in correspondence to the top portion of the bellows 7; this positioning of the outlet 27*a* is however only preferable, but not necessary.

Advantageously two contiguous single-piece elements (for example the single-piece elements 13*a* and 13*b* illustrated in the enclosed Figures) are watertight fixed one another preferably by welding, and/or by gluing, and/or by joint.

Opportunely, between two contiguous single-piece elements (for example the single-piece elements 13*a* and 13*b* illustrated in the enclosed Figures) there is a sealing element, not illustrated.

In another embodiment, not illustrated, there could be more than two single-piece elements connected in a series to one another.

In a further embodiment, also not illustrated, the water line 13 comprises only one single-piece element, coinciding in this case with the water line 13, obtained in a single-piece construction with the housing 9.

In a further embodiment thereof, also not illustrated, the water line 13 comprises only one single-piece element, coinciding also in this case with the water line 13, which can be obtained, for example, by injection moulding of a plastic material, and which can be fixed to the housing 9, for example, by welding and/or gluing, and/or by joint.

Anyway, in all the embodiment hitherto illustrated, independently from the number of single-piece elements connected in series, the second conduits 27 of the one or more single-piece elements 13 are fluidly connected, upstream, to the by-pass line 20, and, downstream, to the tub 5, in such a way that a flow of fresh or clean water can flow from the by-pass line 20 to the second conduit 27.

However it is underlined that the second conduits 27 of the one or more single-piece elements 13 can also be fluidly connected, upstream, to the water source directly, that is without being connected to a by-pass line; in this case these second conduits 27 can be connected to a water source, for example, via a suitable tube or pipe.

Figure 16:
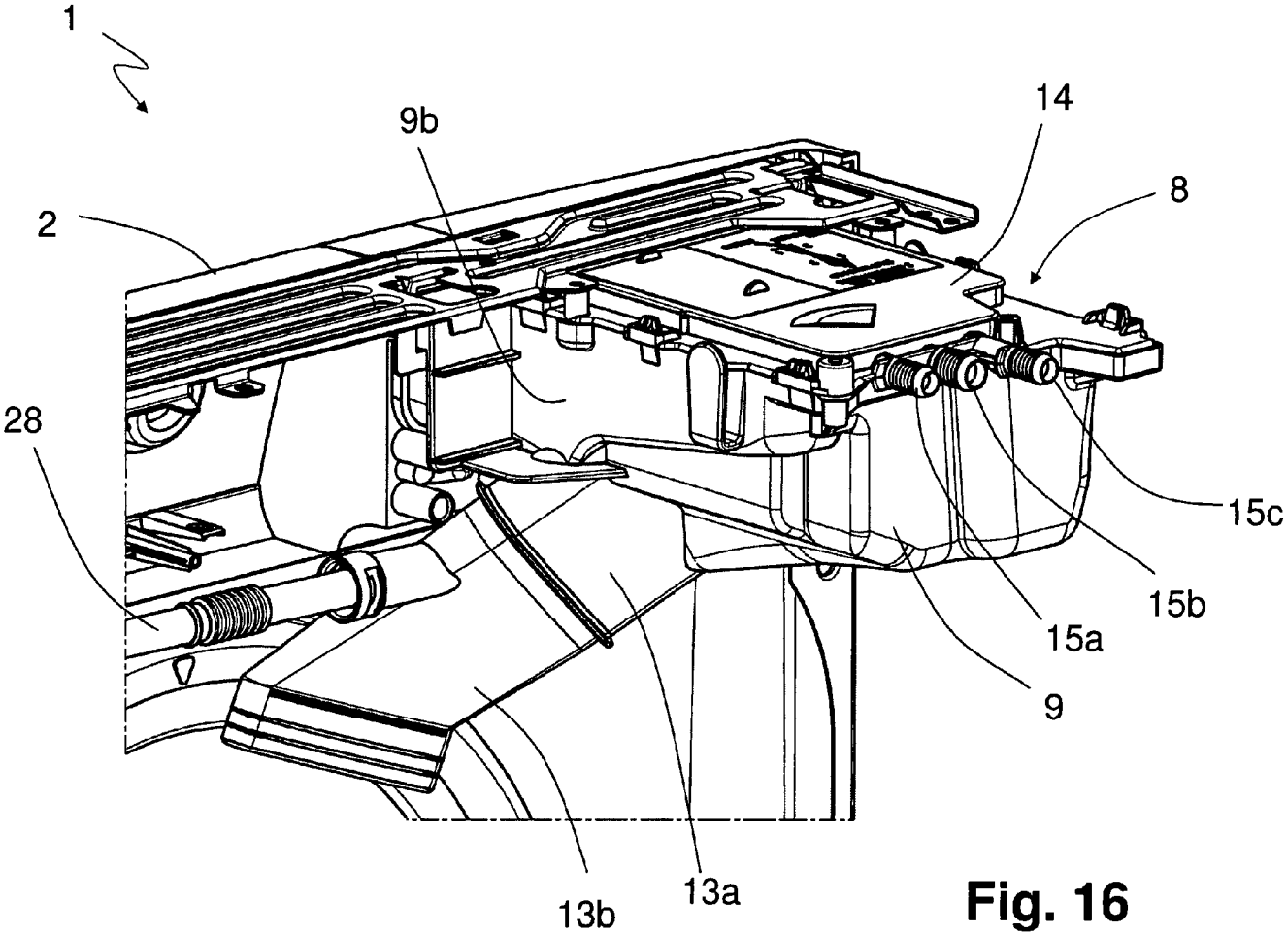
FIG. 16 is a perspective view of a particular of a further embodiment of a washing machine according to the invention.
Figure 17:
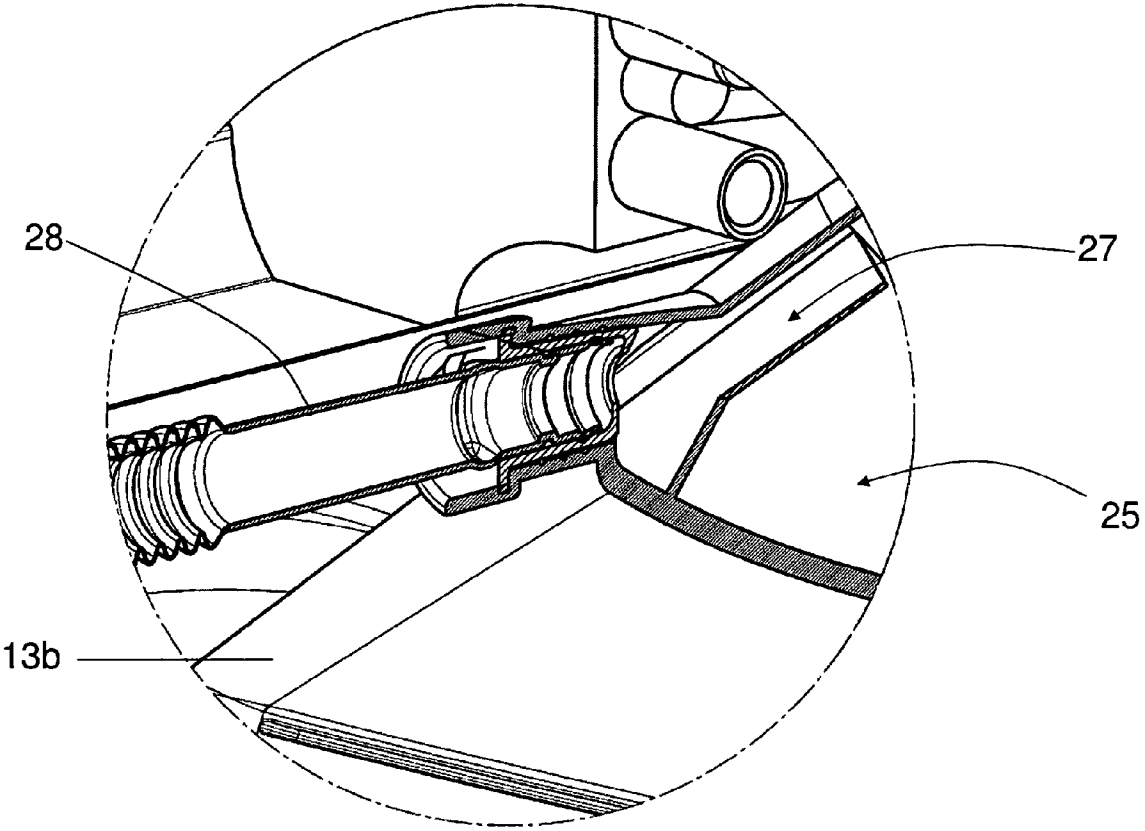
FIG. 17 is a prospective view, partially sectioned, of a particular of the washing machine represented in FIG. 16.

In a further embodiment, illustrated in FIGS. 16 and 17, the washing machine 1 comprises also a recirculation circuit adapted to drain the washing/rinsing-liquid (i.e. water or water mixed with washing or rinsing products) from the bottom of the tub 5 and to re-admit this re-circulated washing/rinsing-liquid into an upper region of the tub 5, in order to improve the wetting of the laundry contained in the tub 5.

Advantageously, the recirculation circuit comprises a draining circuit, not illustrated, connected to the bottom of the tub 5 and provided with a pump, again not illustrated, adapted to take the washing/rinsing-liquid from the bottom of the tub 5, and to re-admitting the re-circulated washing/rinsing-liquid in the rotary perforated drum 6, typically from an upper region of the latter, via an inlet tube 28.

In the washing machine 1 according to the invention, the inlet tube 28 advantageously flows into the second conduit 27 or the single-piece element 13*b*; in this way the second conduit 27 of the single-piece element 13*b* can also be used to flow into the rotating drum 6 the re-circulated washing/rinsing liquid.

Obviously, if the water line 13 comprises more than one single-piece elements, the inlet tube 28 can flow in the second conduit of any of such single-piece elements comprised in the water line 13.

The functioning of a washing machine according to the invention is as follows: with reference to the enclosed Figures, by opening the controllable valve 40 connected to the inlet connector 15*b*, clean or fresh water, coming from the water source, enters the water distributor 14, crosses the air-gap or air-break 16, and enters the by-pass line 20, from which it flows into the second conduits 27 of the water line 13, and finally enters the tub 5, and therefore the drum 6, through the opening 26 obtained in the bellows 7.

This clean or fresh water enters in the drum 6 from a frontal-upper region of the latter, wetting the laundry contained therein.

After this initial wetting phase, by operating the controllable valves 40, water can be introduced also in the ducts 17*a* and/or 17*b*, from where it reaches one of or both the regions 18*a*, 18*b*, and then one of or both the compartments 11*a*, 11*b*.

For example, with reference to FIG. 4, by opening only the controllable valve associated to the inlet connector 15*a*, clean water coming from the water source enters the water distributor 14, crosses the air-gap 16, and enters the duct 17*a*.

By opening both the controllable valves associated to the inlet connectors 15*a* and 15*b*, two jets, not illustrated, of clean water coming from the water source, enter the water distributor 14, and converge each other, substantially in correspondence to the air-gap 16, such as to generate a single jet which enters the duct 17*b*.

In the compartments 11*a*, 11*b*, water mixes with the washing and/or rinsing products therein contained, and then flows in the tub 5 through the first conduits 25 of the water line 13.

As indicated above, if the washing machine 1 is provided with a recirculation circuit, during washing and rinsing phases the washing/rinsing-liquid can be re-circulated in order to ensure a better wetting of the laundry by such water; as disclosed above, the washing/rinsing-liquid can be drained from the bottom of the tub 5, and re-admitted into the latter via the second conduit 27 of the single-piece element 13*b*.

It is seen therefore how the invention can be used to achieves the proposed aim and objects, there being provided a washing machine, which could be both a "simple" washing machine or also a washing-drying machine, which, thanks to the particular structure of the water line, allows introducing selectively in the tub clean or fresh water without the risk that the latter would come into contact with washing or rinsing agent before entering the tub, contemporarily reducing the complexity and the encumbrance of the circuit for the adduction of water and/or detergents to the tub.

In this way the invention also reduces the costs for assembly the circuit for the adduction of water and/or detergents to the tub.

In addition, if the washing machine is provided with a recirculation circuit, the connection of the inlet tube with the second duct of one of the one or more single-piece elements, allows reducing the complexity and the encumbrance of the recirculation circuit.

The invention claimed is:

1. A washing machine comprising:

a washing tub containing a rotary perforated drum;

a washing/rinsing-liquid dispenser, fluidly connectable to a water source, comprising a housing and a drawer, removably associated to said housing, provided with one or more compartments adapted to be filled with washing and/or rinsing products; and a water line fluidly connecting said washing/rinsing-liquid dispenser and said tub, wherein said water line comprises one or more single-piece elements comprising a first conduit, fluidly connecting said one or more compartments and said tub, and a second conduit fluidly connectable, at an upstream end, with said water source, and fluidly connected, at a downstream end, with said tub, said second conduit being fluidly separated from said first conduit along its length between its upstream and downstream ends, said first and second conduits being provided in a single-piece construction.

2. A washing machine according to claim 1, wherein said water line comprises two or more of said single-piece elements, connected in series in such a way that their first conduits are fluidly connected one another, and that their second conduits are fluidly connected one another.

3. A washing machine according to claim 2, wherein two contiguous single-piece elements are watertightly fixed to one another.

4. A washing machine according to claim 3, wherein two contiguous single-piece elements are watertightly fixed to one another by welding, and/or by gluing, and/or by joint.

5. A washing machine according to claim 3, wherein between the two contiguous single-piece elements there is a sealing element.

6. A washing machine according to claim 1, wherein at least one of said one or more single-piece elements has a single-piece construction with said housing.

7. A washing machine according to claim 1, wherein at least one of said one or more single-piece elements is fixed to said housing (9) by welding and/or gluing, and/or joint.

8. A washing machine according to claim 1, wherein the second conduit of at least one of said one or more single-piece elements is provided with an outlet arranged in such a way that a jet of clean or fresh water exiting from said outlet is oriented towards an upper central region of said rotary perforated drum.

9. A washing machine according to claim 1, wherein one of said one or more single-piece elements is connected, downstream, to a flexible bellows, connecting said tub and an access opening of said washing machine, in such a way that the outlet of the second conduit of said single-piece element is positioned substantially in a top portion of said flexible bellows.

10. A washing machine according to claim 1, wherein the first conduit and the second conduit of each one of said single-piece elements, are parallel to one another.

11. A washing machine according to claim 1, wherein a recirculation circuit is provided, adapted to drain the washing/rinsing-liquid from the bottom of said tub and to re-admit this re-circulated washing/rinsing-liquid into an upper region of said tub, said recirculation circuit being fluidly connected to the second conduit of one of said one or more single-piece elements, in such a way that said re-circulated washing/rinsing-liquid is admitted into said tub via said second conduit.

12. A washing machine according to claim 1, wherein the second conduit of at least one of said one or more single-piece elements is fluidly connected, upstream, to a by-pass line, obtained in said washing/rinsing-liquid dispenser and fluidly connectable, upstream, to said water source, in such a way that a flow of fresh or clean water can flow from said by-pass line to said second conduit.

* * * * *